US009708142B2

(12) United States Patent
Ohta

(10) Patent No.: US 9,708,142 B2
(45) Date of Patent: Jul. 18, 2017

(54) SHEET CONVEYING APPARATUS

(71) Applicant: Brother Kogyo Kabushiki Kaisha, Nagoya-shi, Aichi-ken (JP)

(72) Inventor: Masahiko Ohta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/379,844

(22) Filed: Dec. 15, 2016

(65) Prior Publication Data

US 2017/0096309 A1 Apr. 6, 2017

Related U.S. Application Data

(63) Continuation of application No. 15/009,929, filed on Jan. 29, 2016, now Pat. No. 9,546,059.

(30) Foreign Application Priority Data

Jan. 29, 2015 (JP) ..... 2015-015989

(51) Int. Cl.

| | |
|---|---|
| ***B65H 3/52*** | (2006.01) |
| ***B65H 1/04*** | (2006.01) |
| ***B65H 3/06*** | (2006.01) |
| ***B65H 5/06*** | (2006.01) |

(52) U.S. Cl.

CPC ..... *B65H 3/5215* (2013.01); *B65H 1/04* (2013.01); *B65H 3/0661* (2013.01); *B65H 5/062* (2013.01); *B65H 2601/324* (2013.01); *B65H 2801/39* (2013.01)

(58) Field of Classification Search

CPC ..... B65H 3/06; B65H 3/0661; B65H 3/52; B65H 3/5207; B65H 3/5215; B65H 3/5223; B65H 3/5238; B65H 2402/30; B65H 2402/31

USPC ..... 271/121, 104, 124, 137

See application file for complete search history.

(56) References Cited

U.S. PATENT DOCUMENTS

| | | | |
|---|---|---|---|
| 5,568,166 | A | 10/1996 | Yamazaki |
| 6,564,966 | B2 | 5/2003 | Kaiga et al. |
| 6,659,450 | B2 | 12/2003 | Fukasawa et al. |

(Continued)

FOREIGN PATENT DOCUMENTS

| | | | |
|---|---|---|---|
| EP | 00281073 | | 9/1988 |
| JP | 3618659 | B2 | 2/2005 |
| JP | 3689629 | B2 | 8/2005 |

*Primary Examiner* — David H Bollinger

(74) *Attorney, Agent, or Firm* — Banner & Witcoff, Ltd.

(57) ABSTRACT

A sheet conveying apparatus, including: a base body having a conveyor surface; a separating roller configured to rotate about a first rotation axis parallel to a width direction of the conveyor surface and to convey a sheet downstream in a conveyance direction orthogonal to the width direction; a separating piece opposed to the separating roller and configured to cooperate with the separating roller to separate sheets being conveyed one by one; an attachment member removably attached to the base body at a position at which the attachment member is opposed to the separating roller, so as to form a part of the conveyor surface; a holder holding the separating piece and supported by the attachment member so as to be movable toward and away from the separating roller; and a first urging member provided between the attachment member and the holder for urging the separating piece toward the separating roller.

10 Claims, 11 Drawing Sheets

(56) References Cited

U.S. PATENT DOCUMENTS

| | | | |
|---|---|---|---|
| 2002/0038932 | A1 | 4/2002 | Kaiga et al. |
| 2002/0096819 | A1 | 7/2002 | Fukasawa et al. |

FIG.10
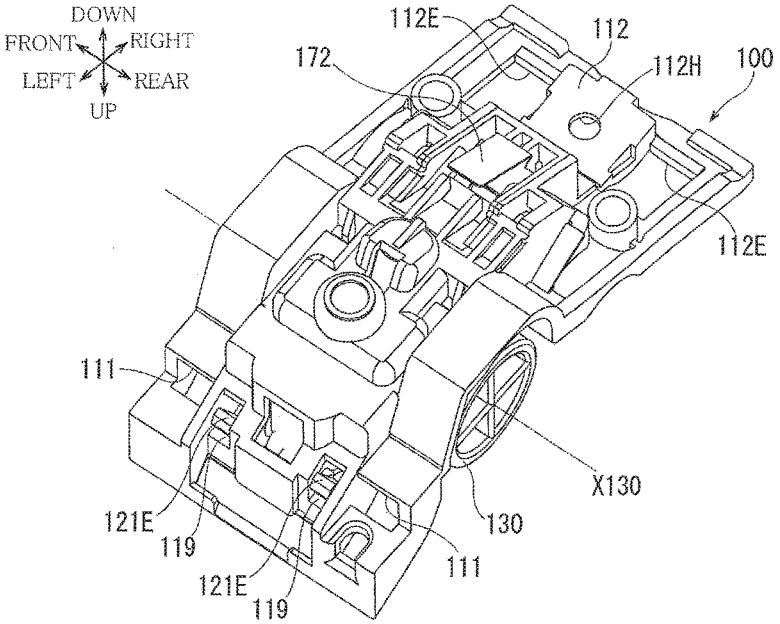
FIG.11A
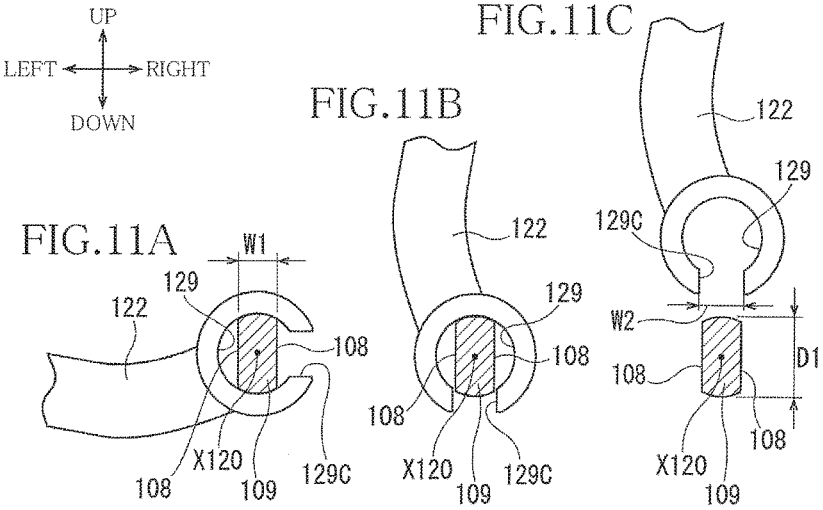
FIG.11B
FIG.11C

SHEET CONVEYING APPARATUS

CROSS REFERENCE TO RELATED APPLICATION

The present application is a continuation of U.S. patent application Ser. No. 15/009,929 filed Jan. 29, 2016, which claims priority from Japanese Patent Application No. 2015-015989, which was filed on Jan. 29, 2015, the disclosure of which are herein incorporated by reference in their entirety.

BACKGROUND

Technical Field

The following disclosure relates to a sheet conveying apparatus.

Description of the Related Art

There has been known a sheet conveying apparatus having a conveying frame, a separating roller functioning also as a supply roller, a separation piece, a holder, and a spring.

The conveying frame forms a conveying surface on which a sheet is conveyed. The separating roller is disposed above the conveying surface. The separating roller is configured to rotate about a rotation axis parallel to a width direction of the conveying surface for conveying the sheet downstream in a conveyance direction orthogonal to the width direction. The separation piece disposed so as to be opposed to the separating roller and cooperates with the separating roller to separate the sheets one by one. The holder holds the separation piece and is supported by the conveying frame so as to be movable toward and away from the separating roller. The spring is provided between the conveying frame and the holder for urging the separation piece toward the separating roller.

For replacing the separation piece with a new one in the known sheet conveying apparatus, the separation piece and the holder which have been used are removed from a base body of the apparatus. In this instance, the spring is kept held by the conveying frame without being removed. Subsequently, a new separation piece and a new holder are installed on the conveying frame.

SUMMARY

When the new separation piece and the new holder are installed on the conveying frame in the known sheet conveying apparatus described above, the spring held by the conveying frame needs to be engaged with a predetermined portion of the holder. If the holder and the spring are positioned inappropriately relative to each other, a required urging force does not act between the separation piece and the separating roller, causing a risk of a decrease in sheet separating property. Thus, a certain degree of accuracy is required in maintenance work for replacing the separating piece in the conventional sheet conveying apparatus.

One aspect of the disclosure relates to a sheet conveying apparatus capable of simplifying maintenance work in relation to replacement of a separating piece.

In one aspect of the disclosure, a sheet conveying apparatus includes: a base body having a conveyor surface on which a sheet is conveyed; a separating roller configured to rotate about a first rotation axis parallel to a width direction of the conveyor surface and to convey the sheet downstream in a conveyance direction orthogonal to the width direction; a separating piece located so as to be opposed to the separating roller and configured to cooperate with the separating roller to separate sheets being conveyed one by one; an attachment member removably attached to the base body at a position at which the attachment member is opposed to the separating roller, so as to form a part of the conveyor surface; a holder holding the separating piece and supported by the attachment member so as to be movable toward and away from the separating roller; and a first urging member provided between the attachment member and the holder for urging the separating piece toward the separating roller.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which:

FIG. 10 is a perspective view showing a back surface of the unit assembly;

FIGS. 11A-11C are schematic views each showing a cross-section along line A-A in FIG. 8 for explaining a procedure to attach and detach the holder to and from the fit-in member.

DETAILED DESCRIPTION OF THE EMBODIMENT

Hereinafter, there will be described one embodiment by reference to the drawings.

Embodiment

Figure 1:
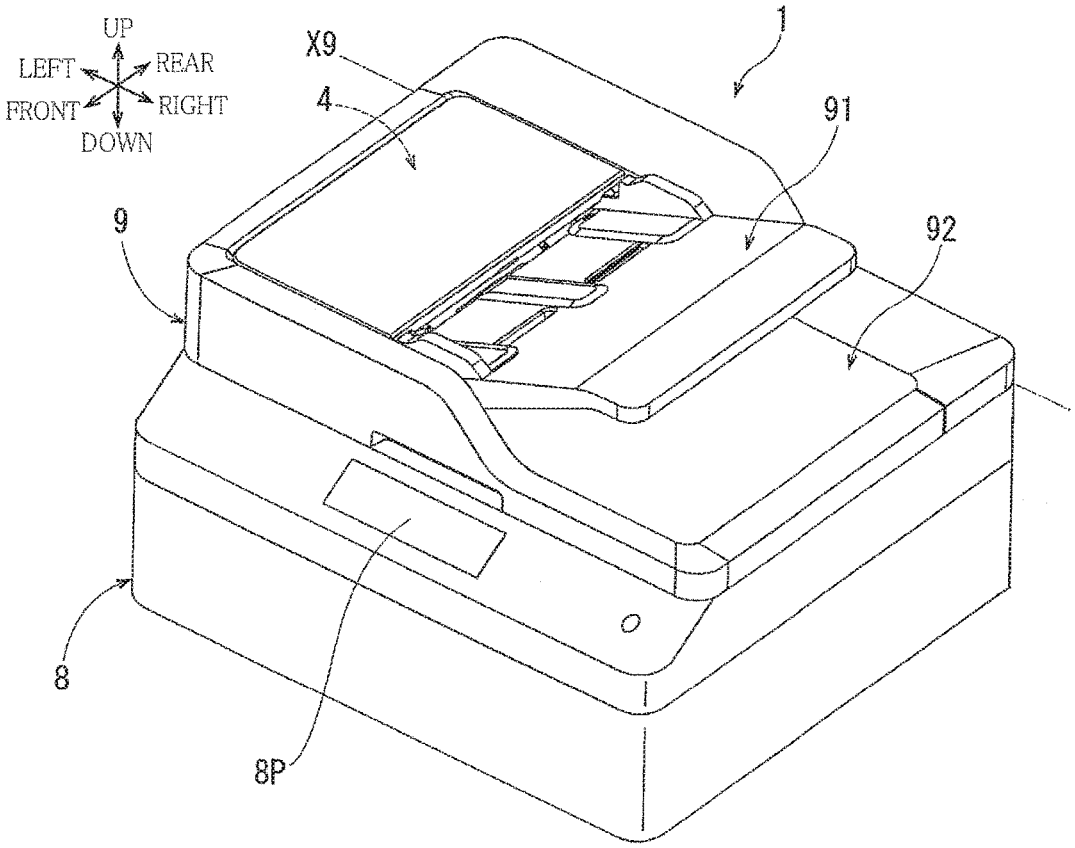
FIG. 1 is a perspective view of an image reading apparatus according to one embodiment.

As shown in FIG. 1, an image reading apparatus 1 according to the embodiment is one example of a sheet conveying apparatus. In FIG. 1, a side of the image reading apparatus 1 on which an operation panel 8P is provided is defined as a front side, and a left side of the image reading apparatus 1 when the image reading apparatus 1 is viewed from the front side is defined as a left side. Further, a front-rear direction, a right-left direction, and an up-down direction are defined based on the definition. Directions indicated in other drawings are similarly defined. Hereinafter, the image reading apparatus 1 will be explained by referring to the drawings.

Configuration

Figure 2:
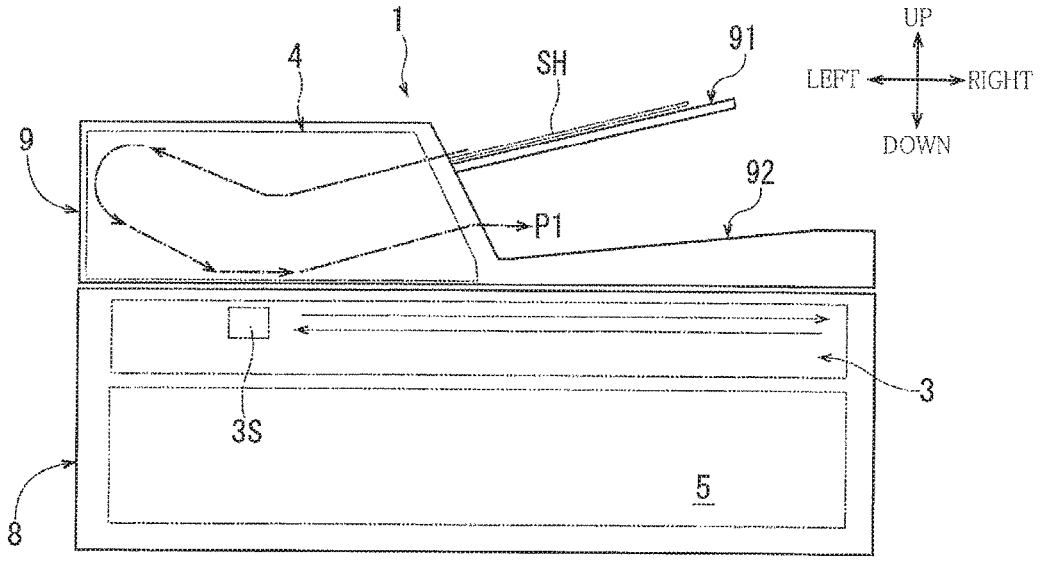
FIG. 2 is a schematic front view of the image reading apparatus.
Figure 3:
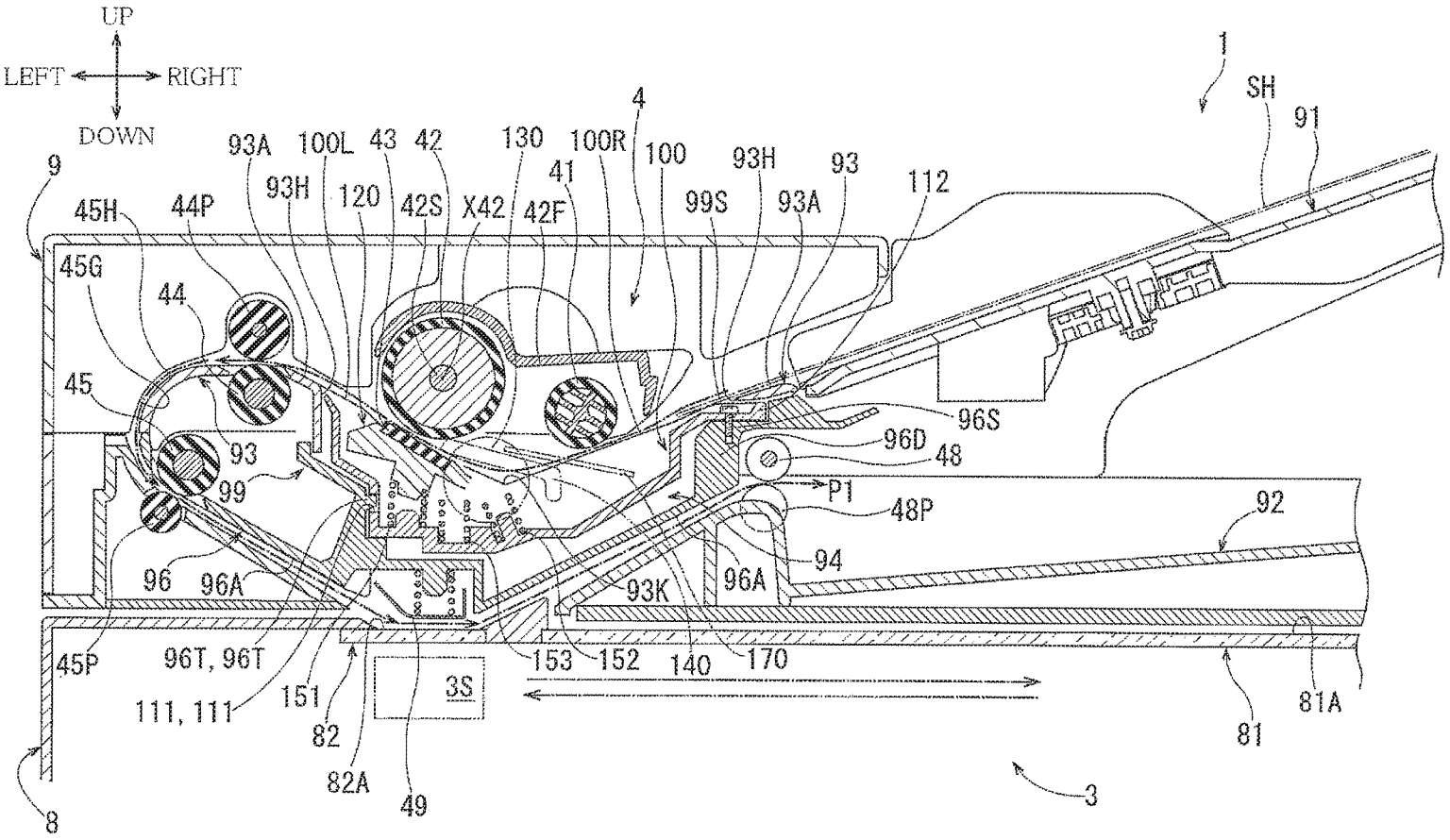
FIG. 3 is a cross-sectional view of a portion of the image reading apparatus.

As shown in FIGS. 1-3, the image reading apparatus 1 includes a main body 8, an opening and closing portion 9, an image forming unit 5, a reading unit 3, and a conveying unit 4. The main body 8 is shaped like a substantially flat box. As shown in FIG. 1, the operation panel 8P, such as a touch panel, is provided on a front surface of the main body 8.

As shown in FIG. 2, the image forming unit 5 is housed in a lower portion of the main body 8. The image forming unit 5 performs ink-jet printing or laser printing, for instance, for forming an image on a sheet. The reading unit 3 is housed in an upper portion of the main body 8. As shown in FIGS. 2 and 3, the reading unit 3 is used for reading an image on a document. The conveying unit 4 is provided in the opening and closing portion 9. The conveying unit 4 conveys sheets SH placed on a supply tray 91 one by one along a conveyance path P1 for permitting the reading unit 3 to read an image on each sheet SH.

As shown in FIG. 3, a first platen glass 81 and a second platen glass 82 are disposed on an upper surface of the main body 8. An upper surface of the first platen glass 81 forms a document support surface 81A. When the reading unit 3 reads an image on a stationary document, the document support surface 81A supports the document from below. Examples of the document to be read include sheets such as paper and OHP sheets, and books. The second platen glass 82 is located to the left of the first platen glass 81 and has a narrow elongated shape extending in the front-rear direction. An upper surface of the second platen glass 82 forms a reading surface 82A. When the reading unit 3 reads an image on the sheet SH conveyed by the conveying unit 4, the reading surface 82A guides the conveyed sheet SH from below. In the present embodiment, an object whose image is to be read using the document support surface 81A is referred to as "document", and an object whose image is to be read while being conveyed by the conveying unit 4 is referred to as "sheet SH". The document and the sheet SH may be the same.

As shown in FIG. 1, the opening and closing portion 9 is supported by the main body 8 through hinges (not shown) provided on un upper edge of a rear surface of the main body 8, such that the opening and closing portion 9 is pivotable about an axis X9 extending in the right-left direction. In a closed state shown in FIGS. 1-3, the opening and closing portion 9 covers the document support surface 81A from above. While not shown, the opening and closing portion 9 is configured to pivot about the axis X9 such that a front end portion of the opening and closing portion 9 is moved upward and rearward. When the opening and closing portion 9 is thus moved to its open position at which the document support surface 81A is exposed, a user can place a document to be read on the document support surface 81A.

As shown in FIG. 3, the reading unit 3 includes a reading sensor 3S housed in the upper portion of the main body 8 and a scanning mechanism (not shown). The scanning mechanism reciprocates the reading sensor 3S in the main body 8 in the right-left direction under the document support surface 81A and the reading surface 82A. When reading an image on a document supported on the document support surface 81A, the reading sensor 3S reads the image while moving under the document support surface 81A. A position under the reading surface 82A at which the reading sensor 3S is stopped is a predetermined stationary reading position. When reading an image on a sheet SH being conveyed by the conveying unit 4, the reading sensor 3S is stopped at the stationary reading position. The reading sensor 3S is a known image reading sensor such as a contact image sensor (CIS) or a charge coupled device (CCD).

As shown in FIGS. 2 and 3, the conveying unit 4 includes the supply tray 91, a discharge tray 92, and a base body 99. The supply tray 91 is disposed to the right of the opening and closing portion 9. The discharge tray 92 is disposed below the supply tray 91. As shown in FIGS. 3-6, the base body 99 includes an upper chute member 93 and a lower chute member 96. The upper chute member 93 is one example of "first body portion". The lower chute member 96 is one example of "second body portion".

An upper surface of the supply tray 91 is a flat surface inclined downward to the left. An upper surface of the supply tray 91 is continuous to an upper conveying surface 93A formed by the upper chute member 93 of the opening and closing portion 9. The upper conveying surface 93A is one example of "conveyor surface formed by the base body". The width direction of the upper conveying surface 93A corresponds to the front-rear direction in the present embodiment.

As shown in FIGS. 2 and 3, the supply tray 91 supports, from below, a stack of the sheets SH each of which is to be conveyed by the conveying unit 4 for image reading.

The sheets SH for which images have been read by the reading sensor 3S and which have been conveyed by the conveying unit 4 are discharged to the discharge tray 92.

As shown in FIG. 3, the conveying unit 4 defines, in the opening and closing portion 9, a conveyance path P1 as a space surrounded by: guide surfaces such as the upper conveying surface 93A of the upper chute member 93 and a lower conveying surface 96A of the lower chute member 96; and conveying rollers and other components. The conveyance path P1 includes: a leftward extending portion extending leftward from the supply tray 91 along the upper conveying surface 93A of the upper chute member 93; a downwardly curved portion; a downwardly inclined portion toward the reading surface 82A; a rightward extending portion extending rightward by a short distance along the reading surface 82A; and an upwardly inclined portion that extends rightward to the discharge tray 92.

The conveyance direction in which the sheet SH is conveyed by the conveying unit 4 is the left direction in the upper leftward extending portion along the upper conveying surface 93A. The conveyance direction changes from the left direction to the right direction in the downwardly curved portion. The conveyance direction is the right direction in a lower portion of the conveyance path P1 which extends from the reading surface 82A to the discharge tray 92. The conveyance direction is orthogonal to the front-rear direction that coincides with the width direction of the upper conveying surface 93A.

The upper chute member 93 and the lower chute member 96 are mounted onto components of the discharge tray 92 and components that constitute side walls of the opening and closing portion 9. The lower chute member 96 is opposed to the upper chute member 93 from below. In other words, the lower chute member 96 and a separating roller 42 later described are opposed to each other with the upper chute member 93 interposed therebetween.

As shown in FIG. 3-6, an upper surface of the upper chute member 93 forms the upper conveying surface 93A that defines, from above, the upper portion of the conveyance path P1. The upper conveying surface 93A is a flat surface that is inclined downward to the left, bent at a bent portion 93K, and inclined upward to the left.

As shown in FIG. 3, a lower surface of the lower chute member 96 forms the lower conveying surface 96A that defines, from below, the lower portion of the conveyance path P1.

The conveying unit 4 includes a supply roller 41, the separating roller 42, and a roller holder 42F.

The separating roller 42 is disposed above and opposed to the upper conveying surface 93A of the upper chute member 93. Specifically, the separating roller 42 is opposed, from above, to a downstream portion of the upper conveying surface 93A located downstream of the bent portion 93K in the conveyance direction. The separating roller 42 is mounted on a drive shaft 42S. The drive shaft 42S is a cylindrical shaft body having, as a center axis, a first rotation axis X42 extending in the front-rear direction. The separating roller 42 rotates about the first rotation axis X42 together with the drive shaft 42S.

Figure 4:
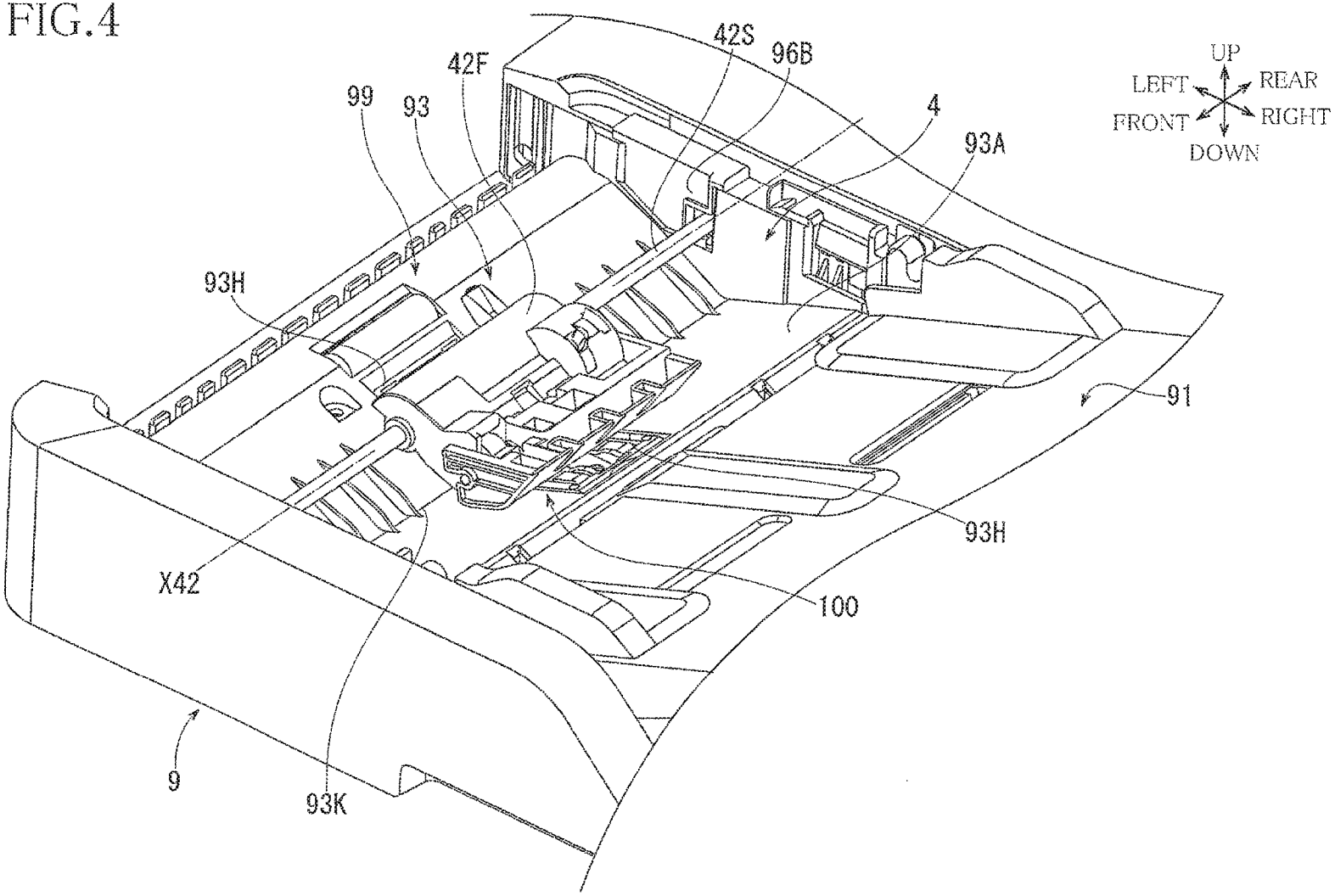
FIG. 4 is a fragmentary perspective view of the image reading apparatus, the view showing an opening and closing portion with a cover removed.

As shown in FIG. 4, a rear end portion of the drive shaft 42S is rotatably supported by a rear inner wall 96B of the lower chute member 96. While not shown, a front end portion of the drive shaft 42S is rotatably supported by a front inner wall of the lower chute member 96. That is, the separating roller 42 is supported by the lower chute member 96.

As shown in FIGS. 3 and 4, the roller holder 42F is supported by the drive shaft 42S so as to be pivotable about the first rotation axis X42. The roller holder 42F protrudes from the drive shaft 42S to the right, namely, protrudes upstream in the conveyance direction.

As shown in FIG. 3, the supply roller 41 is disposed to the right of, namely, upstream of the separating roller 42 in the conveyance direction, such that the supply roller 41 is opposed, from above, to the upper conveying surface 93A of the upper chute member 93. Specifically, the supply roller 41 is opposed, from above, to an upstream portion of the upper conveying surface 93A located upstream of the bent portion 93K in the conveyance direction. That is, the supply roller 41 is contactable with an upper surface of each of the sheets SH supported on the supply tray 91. While not shown, the roller holder 42F is provided with a transmission gear train for transmitting a rotational drive force from the drive shaft 42S to the supply roller 41.

When the drive shaft 42S is driven by a drive source (not shown) and is rotated, the supply roller 41 and the separating roller 42 rotate in synchronization with each other, so that the supply roller 41 gives a conveyance force to an uppermost one of the sheets SH supported on the supply tray 91 and sends the uppermost sheet SH toward the separating roller 42. The separating roller 42 rotates while contacting the sheet SH supplied from the supply tray 91 and thereby conveys the sheet SH to the left, namely, toward the downstream side in the conveyance direction, along the upper portion of the conveyance path P1.

Figure 6:
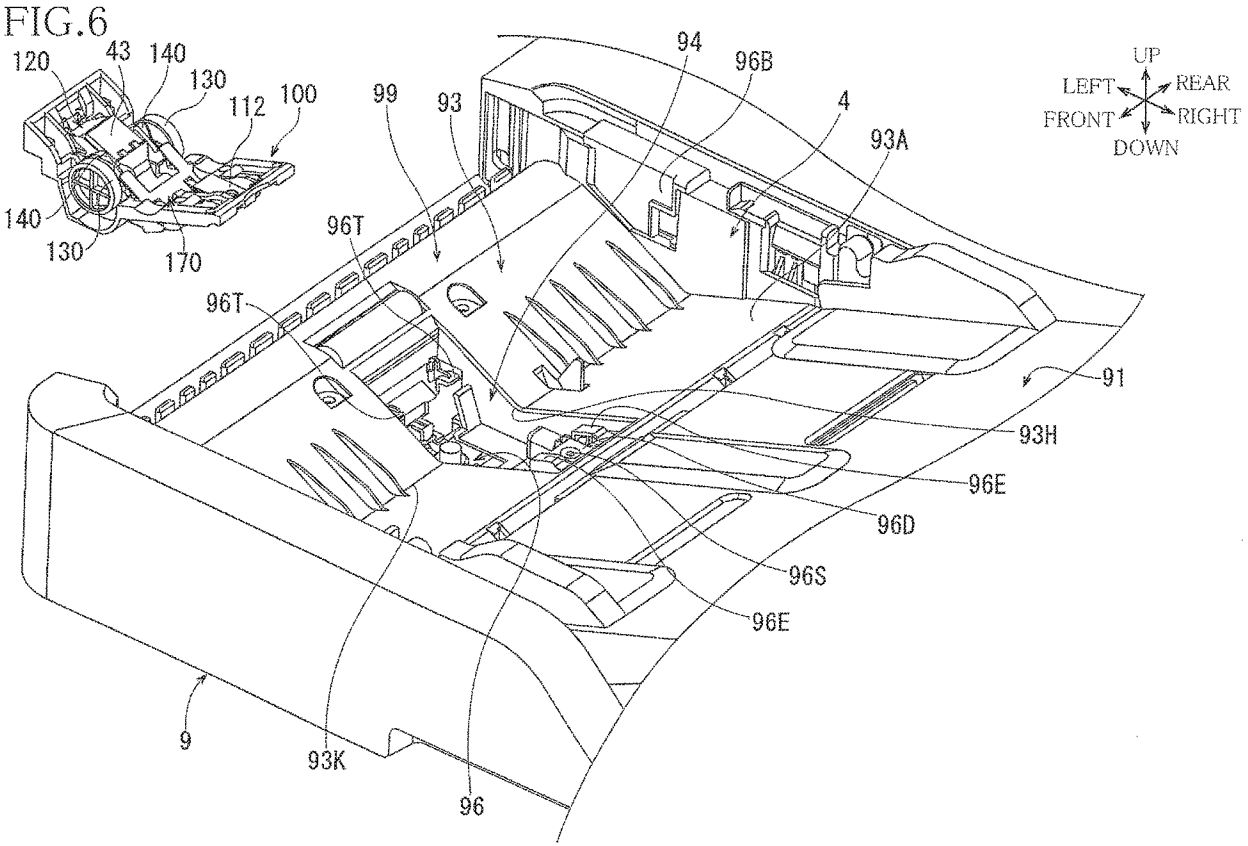
FIG. 6 is a fragmentary perspective view of the image reading apparatus, the view showing the opening and closing portion in a state in which a fit-in member, a separating piece, rollers, arms, a film, and other components, which are formed as a unit assembly, are further removed from the image reading apparatus shown in FIG. 5.

As shown in FIG. 6, for instance, the upper chute member 93 is provided with an opening 93H formed by cutting a portion thereof located below the supply roller 41 and the separating roller 42. The opening 93H is continuous from the upstream portion of the upper conveying surface 93A located upstream of the bent portion 93K in the conveyance direction to the downstream portion of the upper conveying surface 93A located downstream of the bent portion 93K in the conveyance direction.

As shown in FIGS. 3 and 6, a part of the lower chute member 96 is located below the opening 93H, and a fit-in space 94 is defined by the part of the lower chute member 96 and the periphery of the opening 93H. The lower chute member 96 is provided with a fastening base 96D and a pair of engaging projections 96T, 96T arranged in the front-rear direction. The fastening base 96D is located at a right portion of the fit-in space 94 and has a threaded hole 96S formed in its upper surface. As shown in FIG. 6, the fastening base 96D is sandwiched, in the front-rear direction, by positioning protrusions 96E, 96E protruding upward. As shown in FIGS. 3 and 6, the engaging projection 96T, 96T are located at a left portion of the fit-in space 94 and project rightward. A fit-in member 100 later described is removably fitted in the fit-in space 94.

Figure 5:
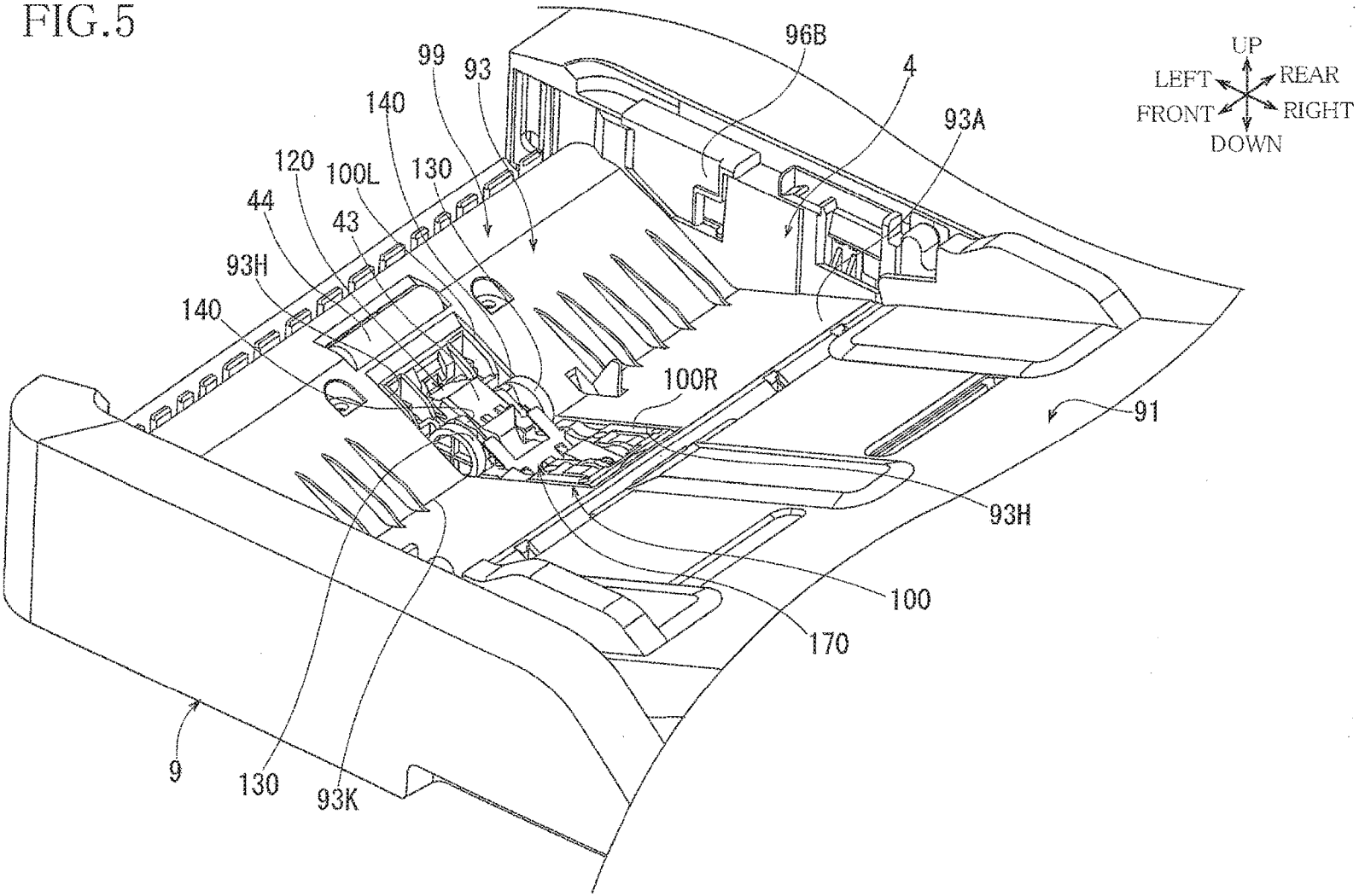
FIG. 5 is a fragmentary perspective view of the image reading apparatus, the view showing the opening and closing portion in a state in which a supply roller, a separating roller, and other components are further removed from the image reading apparatus shown in FIG. 4.

As shown in FIGS. 3-10, the conveying unit 4 includes the fit-in member 100, a separating piece 43, a separating-piece holder 120, a first compression coil spring 151, a pair of rollers 130, 130, a second compression coil spring 152, a pair of arms 140, 140, a third compression coil spring 153, and a film 170. These components are formed as a unit assembly removably attached to the base body 99, as shown in FIGS. 5 and 6. In the following explanation relating to these components, the front-rear direction, the right-left direction, and the up-down direction are defined based on a state in which these components formed as the unit assembly are attached to the base body 99 as shown in FIG. 5.

The fit-in member 100 is one example of "attachment member". The separating-piece holder 120 is one example of "holder". The first compression coil spring 151 is one example of "first urging member". The second compression coil spring 152 is one example of "second urging member". The third compression coil spring 153 is one example of "third urging member".

Figure 7:
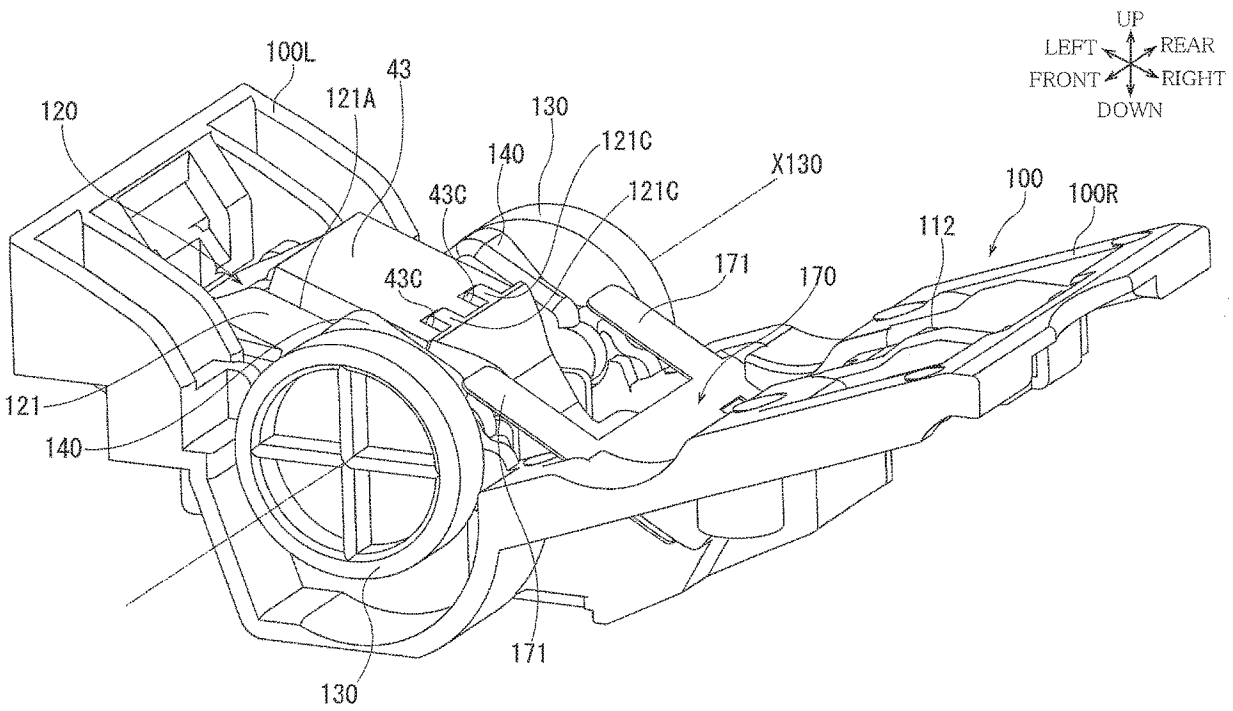
FIG. 7 is a perspective view of the unit assembly.
Figure 8:
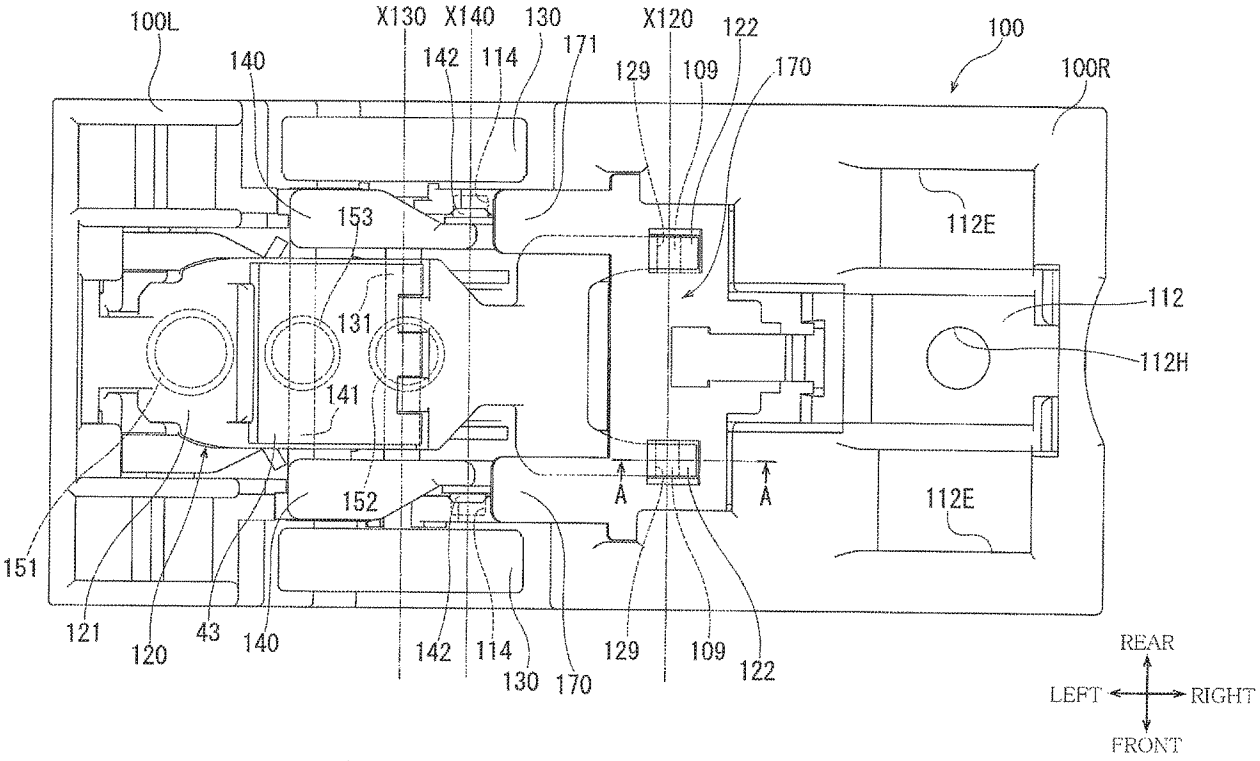
FIG. 8 is a top view of the unit assembly.

As shown in FIGS. 5-10, the fit-in member 100 is formed by molding of resin and is removably attached to the base body 99. Specifically, as shown in FIGS. 3, 8, and 10, for instance, a fastened portion 112 is formed at a right end portion of the fit-in member 100. The fastened portion 112 is recessed downward for accommodating a head of a screw 99S shown in FIG. 3. As shown in FIGS. 8 and 10, a round hole 112H is formed through the thickness of the fastened portion 112 for permitting a shaft of the screw 99S to pass therethrough. The fastened portion 112 is located between positioning holes 112E, 112E in the front-rear direction, each of the positioning holes 112E penetrating the fastened portion 112 in the up-down direction. As shown in FIGS. 3 and 10, a pair of engaging recesses 111, 111 are formed at a left end portion of the fit-in member 100. Each of the engaging recesses 111, 111 is recessed rightward from the left end portion of the fit-in member 100.

The engaging recesses 111, 111 of the fit-in member 100 shown in FIGS. 3 and 10 and the engaging projections 96T, 96T of the lower chute member 96 shown in FIG. 6 are engaged with each other as shown in FIG. 3. The positioning holes 112E, 112E of the fit-in member 100 shown in FIGS. 8 and 10 and the positioning protrusions 96E, 96E of the lower chute member 96 shown in FIG. 6 are engaged with each other. Thus, the fit-in member 100 is positioned relative to the opening 93H. Subsequently, the fastened portion 112 of the fit-in member 100 shown in FIGS. 8 and FIG. 10 and the fastening base 96D shown in FIG. 6 are fastened by the screw 99S shown in FIG. 3. Thus, the fit-in member 100 is attached to the lower chute member 96. The fit-in member 100 is removed from the lower chute member 96 by performing the procedure in reverse order.

As shown in FIG. 7, a right portion of the upper surface of the fit-in member 100, i.e., a first upper surface 100R, is inclined downward to the left while a left portion of the upper surface of the fit-in member 100, i.e., a second upper surface 100L, is inclined upward to the left.

As shown in FIGS. 3 and 5, in a state in which the fit-in member 100 is attached to the lower chute member 96, the first upper surface 100R is located upstream of the bent portion 93K in the conveyance direction and is substantially flush with the upstream portion of the upper conveying surface 93A located upstream of the bent portion 93K in the conveyance direction. Similarly, in the state in which the fit-in member 100 is attached to the lower chute member 96, the second upper surface 100L is located downstream of the bent portion 93K in the conveyance direction and is substantially flush with the downstream portion of the upper conveying surface 93A located downstream of the bent portion 93K in the conveyance direction. In other words, the first upper surface 100R and the second upper surface 100L of the fit-in member 100 define a part of the upper conveying surface 93A.

In the state in which the fit-in member 100 is attached to the lower chute member 96, the first upper surface 100R is opposed to the supply roller 41 from below and the second upper surface 100L is opposed to the separating roller 42 from below. The second upper surface 100L extends toward a downstream side of the separating roller 42 in the conveyance direction. In other words, the fit-in member 100 is removably attached to the base body 99 at a position at which the fit-in member 100 is opposed to the separating roller 42.

As shown in FIG. 8, the fit-in member 100 is provided with a pair of shafts 109, 109 arranged in the front-rear direction. The shafts 109, 109 have a generally cylindrical shape and define a pivot axis X120 extending in the front-rear direction. The pivot axis X120 is located on the right side of the center of the fit-in member 100 on which the first upper surface 100R is formed, and is located to the left of the fastened portion 112. As shown in FIG. 11, each of the shafts 109, 109 has a substantially cylindrical shape, and a pair of flat surfaces 108, 108 are formed on its outer circumferential surface. The flat surfaces 108, 108 are opposed to each other such that the pivot axis X120 is sandwiched therebetween in the right-left direction.

Figure 9:
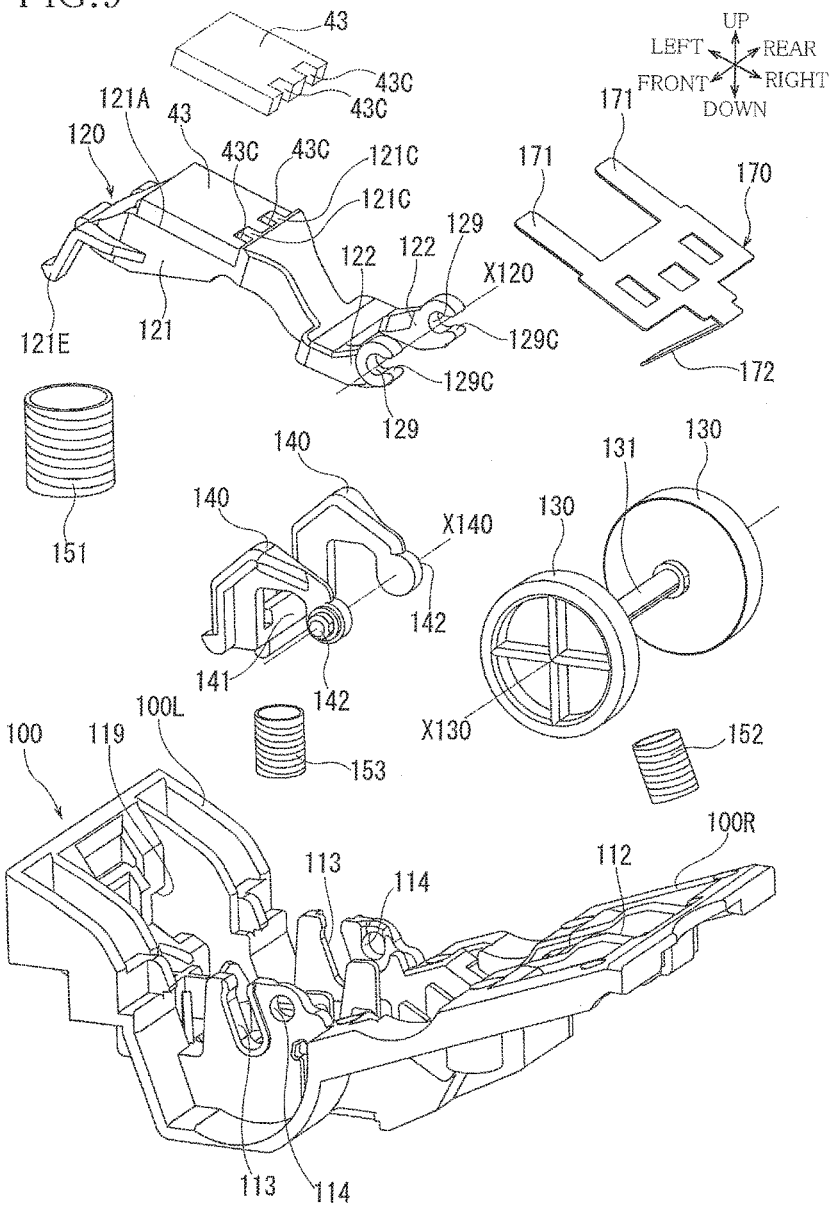
FIG. 9 is an exploded perspective view of the fit-in member, the separating piece, the rollers, the arms, the film, and first through third urging members which constitute the unit assembly.

As shown in FIG. 9, the separating-piece holder 120 is formed by molding of resin and includes a holder main body 121, a pair of protruding portions 122, 122 arranged in the front-rear direction, and a pair of shaft hole portions 129, 129 arranged in the front-rear direction.

A separation-piece support surface 121A is formed at a left portion of the holder main body 121. The separation-piece support surface 121A is a flat surface that inclines upward to the left. A portion of the holder main body 121 located to the right of the separation-piece support surface 121A has a height dimension larger than the separation-piece support surface 121A, and two protrusions 121C, 121C protruding toward the separation-piece support surface 121A are formed so as to be arranged in the front-rear direction. The holder main body 121 extends rightward while being directed downward.

The protruding portions 122, 122 protrude rightward from a right end of the holder main body 121. The shaft hole portions 129, 129 are formed at right ends of the respective protruding portions 122, 122. Each of the shaft hole portions 129, 129 is provided with a cutout 129C.

As shown in FIGS. 8 and 11, the shafts 109, 109 of the fit-in member 100 pass and extend through the corresponding shaft hole portions 129, 129, whereby the separating-piece holder 120 is supported by the fit-in member 100 so as to be pivotable about the pivot axis X120. The pivotal movement of the separating-piece holder 120 about the pivot axis X120 allows the separation-piece support surface 121A to move toward and away from the separating roller 42.

As shown in FIG. 11, the cutout 129C of each shaft hole portion 129 has a width W2 which is larger than a distance W1 between the flat surfaces 108, 108 of each shaft 109 and which is smaller than an outer diameter D1 of each shaft 109.

The posture of the shaft hole portion 129 shown in FIG. 11A corresponds to its posture when the separating-piece holder 120 is supported by the fit-in member 100, as shown in FIG. 7, for instance. In this state, the flat surfaces 108, 108 of each shaft 109 are positioned relative to the cutout 129C so as not to allow the shaft 109 to pass through the cutout 129C. Consequently, the shaft 109 cannot come out of the cutout 129C. When the separating-piece holder 120 is pivoted clockwise in FIG. 11 by 90° as shown in FIG. 11B, the flat surfaces 108, 108 of the shaft 109 are positioned relative to the cutout 129C so as to allow the shaft 109 to pass through the cutout 129C. As a result, the shaft 109 can come out of the cutout 129C as shown in FIG. 11C, so that the separating-piece holder 120 can be detached from the fit-in member 100. The separating-piece holder 120 can be attached to the fit-in member 100 by performing the procedure in reverse order.

As shown in FIG. 9, the separating-piece holder 120 is provided with a pair of engagement portions 121E, 121E arranged in the front-rear direction so as to protrude downward from a left end of the holder main body 121. In FIG. 9, a front-side engagement portion 121E is illustrated, and a rear-side engagement portion 121E is not illustrated. A pair of restrictor holes 119, 119 arranged in the front-rear direction are formed at the left end portion of the fit-in member 100. The restrictor holes 119, 119 are formed through the thickness of the fit-in member 100. In FIG. 9, a rear-side restrictor hole 119 is illustrated, and a front-side restrictor hole 119 is not illustrated.

As shown in FIG. 10, in a state in which the separating-piece holder 120 is mounted on the fit-in member 100, the engagement portions 121E, 121E are held in engagement with the restrictor holes 119, 119, thereby restricting the range of the pivotal movement of the separating-piece holder 120.

As shown in FIG. 9, for instance, the separating-piece holder 120 holds the separating piece 43. Specifically, the separating piece 43 is a frictional member shaped like a plate and is formed of rubber or elastomer, for instance. The separating piece 43 is stuck to the separation-piece support surface 121A of the separating-piece holder 120 by a double-faced tape or the like (not shown). The separating piece 43 is provided with a pair of recesses 43C, 43C arranged in the front-rear direction. The recesses 43C, 43C are formed at a right end portion of the separating piece 43 so as to be recessed leftward. In a state in which the separating piece 43 is stuck to the separation-piece support surface 121A, the protrusions 121C, 121C of the separating-piece holder 120 are fitted in the recesses 43C, 43C of the separating piece 43 and protrude upward of the separating piece 43. This configuration prevents the separating piece 43 from acting like a step that interrupts passage of the sheet SH in the conveyance direction with respect to the holder main body 121 of the separating-piece holder 120.

As shown in FIGS. 3, 8, and 9, the first compression coil spring 151 is provided between the fit-in member 100 and the separating-piece holder 120. While not shown, the upper end of the first compression coil spring 151 is held in contact with the holder main body 121 of the separating-piece holder 120 from below. The lower end of the first compression coil spring 151 is held in contact with a left end portion of the fit-in member 100 from above.

Figure 12:
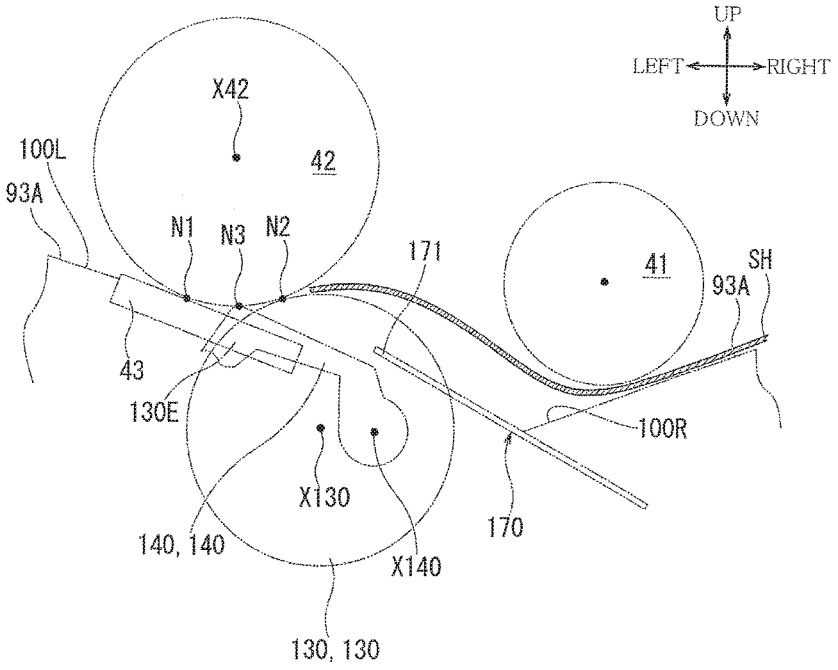
FIG. 12 is a schematic view for explaining operations of the supply roller, the separating roller, the separating piece, the rollers, the arms, the film, and other components.

As shown in FIG. 3, the first compression coil spring 151 urges the separating piece 43 toward the separating roller 42 via the separating-piece holder 120. In an instance where a plurality of sheets SH are conveyed in an overlapping state from the supply roller 41 to the separating roller 42, the separating piece 43 cooperates with the separating roller 42 to separate the overlapping sheets SH one by one. As shown in FIG. 12, the position at which the separating roller 42 and the separating piece 43 nip the sheet SH is referred to as a nip position N1.

As shown in FIGS. 7-9, for instance, the rollers 130, 130 arranged in the front-rear direction are shaped like a disc. The rollers 130, 130 are a resin molded body connected by a cylindrical joint shaft 131. As shown in FIG. 9, a pair of roller guide grooves 113, 113 are formed in the fit-in member 100 so as to be arranged in the front-rear direction. Each of the roller guide grooves 113, 113 is a cutout recessed downward from the second upper surface 100L. The joint shaft 131 is fitted in the roller guide grooves 113, 113 from above, whereby the rollers 130, 130 are held by the roller guide groove 113, 113. The holder main body 121 of the separating-piece holder 120 is disposed over the joint shaft 131. The joint shaft 131 is prevented from coming off the roller guide grooves 113, 113 by the lower surface of the holder main body 121. The rollers 130, 130 are movable toward and away from the separating roller 42 by an upward and downward movement of the joint shaft 131 within the roller guide grooves 113, 113.

The joint shaft 131 defines a second rotation axis X130 extending in the front-rear direction. As shown in FIG. 8, the second rotation axis X130 is located on the left side of the center of the fit-in member 100 on which the second upper surface 100L is formed. As shown FIG. 12, the second rotation axis X130 is located upstream of the nip position N1 in the conveyance direction. As shown in FIG. 8, the rollers 130, 130 are disposed adjacent to one and the other of widthwise opposite end portions of the separating piece 43, so as to sandwich the separating piece 43 therebetween in the front-rear direction. As shown in FIG. 12, each roller 130 has an overlapping portion 130E overlapping the separating piece 43 as viewed from the front-rear direction.

As shown in FIGS. 8 and 9, the second compression coil spring 152 is provided between the fit-in member 100 and the rollers 130, 130. While not shown, the upper end of the second compression coil spring 152 is held in contact, from below, with the joint shaft 131 connecting the rollers 130, 130. The lower end of the second compression coil spring 152 is held in contact with the fit-in member 100 from above.

The second compression coil spring 152 urges the rollers 130, 130 toward the separating roller 42 via the joint shaft 131. As shown in FIG. 12, before a leading edge of the sheet SH to be supplied to the separating roller 42 reaches the nip position N1, the leading edge of the sheet SH conveyed by the supply roller 41 toward the separating roller 42 is guided by the rollers 130, 130 and is nipped by the separating roller 42 and the rollers 130, 130 at a roller contact position N2. This configuration is effective for stabilizing a locus formed by the leading edge of the sheet SH supplied to the separating roller 42, irrespective of the number of the sheets SH supported upstream of the separating roller 42 in the conveyance direction.

As shown in FIGS. 7-9, for instance, the arms 140, 140 arranged in the front-rear direction extend in the right-left direction so as to convexedly curve upward. The arms 140, 140 are a resin molded body connected by a joint 141 at respective left ends thereof. As shown in FIGS. 8 and 9, each of the arms 140, 140 is provided with an arm shaft 142 at its right end. A pair of arm support holes 114, 114 are formed in the fit-in member 100 through the thickness thereof in the front-rear direction. The arm shafts 142, 142 of the arms 140, 140 are fitted in the arm support holes 114, 114 of the fit-in member 100, whereby the arms 140, 140 are supported by the fit-in member 100 so as to be pivotable about a pivot axis X140. The holder main body 121 of the separating-piece holder 120 is disposed over the joint 141, whereby the lower surface of the holder main body 121 restricts a movement of the joint 141 and accordingly restricts the range of the pivotal movement of the arms 140, 140. The arms 140, 140 are movable toward and away from the separating roller 42 by pivoting about the pivot axis X140.

As shown in FIG. 8, the pivot axis X140 is located on the left side of the center of the fit-in member 100 on which the second upper surface 100L is formed, so as to be located to the right of the second rotation axis X130. As shown in FIG. 12, the pivot axis X140 is located upstream of the nip position N1 in the conveyance direction.

As shown in FIG. 8, the arms 140, 140 are disposed adjacent to one and the other of the widthwise opposite end portions of the separating piece 43, so as to sandwich the separating piece 43 therebetween in the front-rear direction. Further, the arms 140, 140 are disposed so as to be sandwiched by the rollers 130, 130 in the front-rear direction. As shown in FIG. 12, the arms 140, 140 are located upstream of the nip position N1 in the conveyance direction.

As shown in FIGS. 8 and 9, the third compression coil spring 153 is provided between the fit-in member 100 and the arms 140, 140. While not shown, the upper end of the third compression coil spring 153 is held in contact, from below, with the joint 141 connecting the arms 140, 140. The lower end of the third compression coil spring 153 is held in contact with the fit-in member 100 from above.

The third compression coil spring 153 urges the arms 140, 140 toward the separating roller 42 via the joint 141. As shown in FIG. 12, before the leading edge of the sheet SH to be supplied to the separating roller 42 reaches the nip position N1, the leading edge of the sheet SH is pressed onto the separating roller 42 by the arms 140, 140 at an arm contact position N3. The arm contact position N3 is located between the nip position N1 and the roller contact position N2 in the conveyance direction. The arms 140, 140 allow the sheet SH that has passed through the roller contact position N2 to be sent toward the nip position N1 at a stable angle, thus resulting in stable sheet separation accuracy at the nip position N1.

As shown in FIG. 8, the first compression coil spring 151, the second compression coil spring 152, and the third compression coil spring 153 are located at a central portion of the fit-in member 100 in the front-rear direction so as to be arranged along the conveyance direction.

As shown in FIGS. 7-9, for instance, the film 170 is obtained by cutting a thin resin sheet such as a polyester film. As shown in FIG. 9, one end portion of the film 170 is split into two portions, i.e., protruding portions 171, 171, protruding leftward. The film 170 has, at another end portion, a bent portion 172 that is bent downward. The film 170 is supported by the fit-in member 100 such that the bent portion 172 penetrates the fit-in member 100 in a direction from the first upper surface 100R toward the back surface of the fit-in member 100 and engages with the back surface of the fit-in member 100, as shown in FIG. 10.

As shown in FIG. 12, the film 170 is disposed upstream of the nip position N1 in the conveyance direction. The film 170 extends downstream in the conveyance direction so as to approach the separating roller 42. Before the leading edge of the sheet SH to be supplied to the separating roller 42 comes into contact with the rollers 130, 130, the leading edge of the sheet SH comes into contact with the film 170 and is guided upward by the protruding portions 171, 171 of the film 170. Thus, the leading edge of the sheet SH is prevented from hitting on the rollers 130, 130 and being accordingly bent. The thus configured film 170 guides, toward the nip position N1, the sheet SH to be supplied to the separating roller 42, resulting in stable sheet separation accuracy.

As shown in FIG. 3, the conveying unit 4 includes, in the upper portion of the conveyance path P1, a conveying roller 44 and a pinch roller 44P disposed to the left of the fit-in member 100, namely, disposed downstream of the fit-in member 100 in the conveyance direction. The conveying roller 44 and the pinch roller 44P nip each of the sheets SH separated one by one by the separating roller 42 and the separating piece 43, and convey the sheet SH toward the downstream side in the conveyance direction.

The conveying unit 4 includes, in the downwardly curved portion of the conveyance path P1, a curved guide surface 45G, a curved guide surface 45H, a conveying roller 45, and a pinch roller 45P. The curved guide surface 45G and the curved guide surface 45H are opposed to each other with a predetermined spacing interposed therebetween. The curved guide surface 45G defines an outer surface of the downwardly curved portion of the conveyance path P1. The curved guide surface 45H defines an inner surface of the downwardly curved portion of the conveyance path P1. The conveying roller 45 and the pinch roller 45P nip the sheet SH conveyed by the conveying roller 44 and the pinch roller 44P, and convey the sheet SH toward the reading surface 82A.

The conveying unit 4 includes a pressing member 49 disposed above and opposed to the reading surface 82A. The pressing member 49 presses the upper surface of the sheet SH conveyed from the conveying roller 45 and brings the sheet SH into contact with the reading surface 82A.

The conveying unit 4 includes an output roller 48 and a pinch roller 48P in a portion of the conveyance path P1 which is located to the right of the pressing member 49 and which inclines upward. The output roller 48 and the pinch roller 48P face the discharge tray 92. The output roller 48 and the pinch roller 48P discharge, onto the discharge tray 92, the sheet SH which has passed over the reading surface 82A.

Image Reading

When the reading unit 3 reads an image on a document supported on the document support surface 81A, the scanning mechanism (not shown) of the reading unit 3 is operated so as to move the reading sensor 3S in the right-left direction between a position under the left edge of the document support surface 81A and a position under the right edge of the document support surface 81A. Thus, the reading sensor 3S reads the image on the document supported on the document support surface 81A. When the image reading is completed, the scanning mechanism moves the reading sensor 3S from a right end portion to a left end portion in the reading unit 3, so that the reading sensor 3S is moved back to its original position.

When the reading unit 3 reads an image on the sheet SH placed on the supply tray 91, the scanning mechanism is operated so as to stop the reading sensor 3S at the stationary reading position under the reading surface 82A. Thereafter, the conveying unit 4 successively conveys the sheets SH placed on the supply tray 91 in the conveyance path P1. In this instance, the sheets SH are separated one by one by the separating roller 42, the separating piece 43, the rollers 130, 130, the arms 140, 140, and the film 170. When the sheet SH passes over the reading sensor 3S located at the stationary reading position while contacting the reading surface 82A, the reading sensor 3S reads the image on the sheet SH passing over the reading sensor 3S. After the image reading, the sheet SH is discharged onto the discharge tray 92 by the output roller 48 and the pinch roller 48P.

Operation and Effect

In the image reading apparatus 1 constructed as described above, the fit-in member 100, the separating piece 43, the separating-piece holder 120, the first compression coil spring 151, the rollers 130, 130, the second compression coil spring 152, the arms 140, 140, the third compression coil spring 153, and the film 170 are formed as one unit assembly, as shown in FIGS. 6-10.

In replacing the separating piece 43 with new one, the fit-in member 100 is removed out of the fit-in space 94 of the base body 99, as shown in FIG. 6, whereby the separating piece 43 that has been used can be detached from the base body 99, together with the separating-piece holder 120, the first compression coil spring 151, and other components of the unit assembly. Replacement of the separating piece 43 is completed by simply fitting, into the fit-in space 94 of the base body 99, a new unit assembly including a new fit-in member 100 holding a new separating piece 43 and other components. In this instance, the rollers 130, 130, the arms 140, 140, and the film 170 can be replaced simultaneously.

Thus, the image reading apparatus 1 according to the embodiment allows easy serviceability. For instance, it is not needed to engage the first compression coil spring 151 with a predetermined portion of the separation-piece holder 120, as required in the conventional sheet conveying apparatus in maintenance work in relation to replacement of the separation piece. Further, the components such as the separating piece 43 can be replaced in a state in which the constituent components of the unit assembly, such as the first compression coil spring 151, are kept positioned properly in the unit assembly. This configuration prevents or reduces a trouble such as lowered sheet separating property caused by replacement of the separating piece 43.

According to the image reading apparatus 1, before the leading edge of the sheet SH to be supplied to the separating roller 42 is nipped by the separating roller 42 and the separating piece 43 at the nip position N1, the leading edge of the sheet SH is nipped by the separating roller 42 and the rollers 130, 130 at the roller contact position N2, as shown in FIG. 12. In particular, the second rotation axis X130 is located upstream of the nip position N1 in the conveyance direction, and each roller 130 has the overlapping portion 130E overlapping the separating piece 43 as viewed from the width direction, so that the roller contact position N2 can be set at a suitable position with respect to the nip position N1. Consequently, the locus formed by the leading edge of the sheet SH supplied to the separating roller 42 is stabilized irrespective of the number of the sheets SH supported upstream of the separating roller 42, resulting in further stable sheet separation accuracy.

In the image reading apparatus 1, the rollers 130, 130 are disposed adjacent to one and the other of the widthwise opposite end portions of the separating piece 43 so as to sandwich the separating piece 43 therebetween in the front-rear direction, as shown in FIG. 8. This configuration allows the sheet SH supplied to the separating roller 42 to be nipped at the roller contact position N2 with high reliability by the separating roller 42 and the rollers 130, 130, as shown in FIG. 12.

In the image reading apparatus 1, the arms 140, 140 are disposed adjacent to one and the other of the widthwise opposite end portions of the separating piece 43 so as to sandwich the separating piece 43 therebetween in the front-rear direction, as shown in FIG. 12. The arms 140, 140 bring the sheet SH supplied to the separating roller 42 into pressing contact with the separating roller 42 at the arm contact position N3 located upstream of the nip position N1. This configuration allows the sheet SH that has passed the roller contact position N2 to be sent toward the nip position N1 at a stable angle, resulting in stable sheet separation accuracy at the nip position N1.

In the image reading apparatus 1, the first compression coil spring 151, the second compression coil spring 152, and the third compression coil spring 153 are disposed at the central portion of the fit-in member 100 in the front-rear direction so as to be arranged along the conveyance direction, as shown in FIG. 8. This configuration makes it possible to reduce the dimension of the fit-in member 100 in the front-rear direction and allows the separating-piece holder 120 and the arms 140, 140 to be shaped so as not to interfere with each other.

As shown in FIG. 12, the sheet SH supplied to the separating roller 42 is guided by the film 170 toward the nip position N1 while being prevented from hitting on the rollers 130, 130 and thereby being bent. Thus, the image reading apparatus 1 ensures stable sheet separation accuracy.

As shown in FIGS. 11A-11C, the separating-piece holder 120 is pivoted about the pivot axis X120, so that the flat surfaces 108, 108 of each shaft 109 and the corresponding cutout 129C are positioned relative to each other for permitting the shaft 109 to come out of the cutout 129C. Thus, the separating-piece holder 120 can be easily attached to and detached from the fit-in member 100.

As shown in FIG. 5, for instance, the first upper surface 100R and the second upper surface 100L of the fit-in member 100 define a part of the upper conveying surface 93A and extend from the upstream side of the separating roller 42 in the conveyance direction to the downstream side of the separating roller 42 in the conveyance direction. Consequently, the first upper surface 100R and the second upper surface 100L enable the sheet SH to be appropriately guided on both of the upstream side and the downstream side of the separating roller 42 in the conveyance direction.

As shown in FIG. 3, the base body 99 includes the upper chute member 93 defining the upper conveying surface 93A and the lower chute member 96 opposed to the upper chute member 93 on one of opposite sides of the upper chute member 93 that is remote from the separating roller 42. As shown in FIG. 4, the drive shaft 42S of the separating roller 42 is rotatably supported by the rear inner wall 96B and the front inner wall (not shown) of the lower chute member 96. This configuration leads to enhanced positioning accuracy of the fit-in member 100 with respect to the separating roller 42 and accordingly leads to enhanced positioning accuracy of the separating piece 43 and other components of the unit assembly with respect to the separating roller 42.

In the image reading apparatus 1, the engaging recesses 111, 111 of the fit-in member 100 shown in FIGS. 3 and 10 and the engaging projections 96T, 96T of the lower chute member 96 shown in FIG. 6 are engaged with each other as shown in FIG. 3, and the fastened portion 112 of the fit-in member 100 shown in FIG. 8 and FIG. 10 and the fastening base 96D shown in FIG. 6 are fastened by the screw 99S as shown in FIG. 3, whereby the fit-in member 100 can be easily attached to the lower chute member 96. The fit-in member 100 can be easily detached from the lower chute member 96 by releasing the fastening of the fastened portion 112 and the fastening base 96D and subsequently by disengaging the engaging recesses 111, 111 and the engaging projections 96T, 96T from each other.

While the embodiment of has been explained above, it is to be understood that the disclosure is not limited to the details of the illustrated embodiment, but may be embodied with various other changes and modifications, which may occur to those skilled in the art, without departing from the scope of the disclosure.

The rollers 130, 130 need not be held directly by the fit-in member 100. The rollers may be configured so as to be rotatably held by a roller holder which is movably held by the fit-in member and so as to be movable toward and away from the separating roller.

The disclosure is applicable to not only the image reading apparatus, but also an image forming apparatus, a copying machine, and other similar apparatus.

What is claimed is:

1. A sheet conveying apparatus, comprising:

a base body having a conveyor surface on which a sheet is conveyed;

a separating roller configured to rotate about a first rotation axis parallel to a width direction of the conveyor surface and to convey the sheet downstream in a conveyance direction orthogonal to the width direction;

a separating piece located so as to be opposed to the separating roller and configured to cooperate with the separating roller to separate sheets being conveyed one by one;

an attachment member removably attached to the base body at a position at which the attachment member is opposed to the separating roller, so as to form a part of the conveyor surface;

a holder holding the separating piece and supported by the attachment member so as to be movable toward and away from the separating roller;

a first urging member provided between the attachment member and the holder for urging the separating piece toward the separating roller;

a recessed portion recessed downward relative to the conveyor surface and configured such that the attachment member is engaged thereinto; and a positioning mechanism configured to, when the attachment member is engaged into the recessed portion from above, position the attachment member relative to the base body.

2. The sheet conveying apparatus according to claim 1, wherein the positioning mechanism includes a positioning protrusion provided on the base body and a positioning hole formed in the attachment member.

3. The sheet conveying apparatus according to claim 2, wherein the base body includes a first body portion forming the conveyor surface and a second body portion opposed to the separating roller with the first body portion interposed therebetween, and wherein the positioning protrusion is provided on the second body portion.

4. The sheet conveying apparatus according to claim 1, wherein the positioning mechanism is located at an upstream end portion of the attachment member in the conveyance direction in a state in which the attachment member is engaged into the recessed portion.

5. The sheet conveying apparatus according to claim 1, further comprising an engaging mechanism configured to bring the attachment member and the base body into engagement with each other when the attachment member is engaged into the recessed portion.

6. The sheet conveying apparatus according to claim 5, wherein the engaging mechanism includes an engaging recess formed in the attachment member and an engaging protrusion provided on the base body.

7. The sheet conveying apparatus according to claim 5, wherein the engaging mechanism is located at a downstream end portion of the attachment member in the conveyance direction in a state in which the attachment member is engaged into the recessed portion.

8. The sheet conveying apparatus according to claim 6, wherein the base body includes a first body portion forming the conveyor surface and a second body portion opposed to the separating roller with the first body portion interposed therebetween, and wherein the engaging protrusion is provided on the second body portion.

9. A sheet conveying apparatus, comprising:

a base body having a conveyor surface on which a sheet is conveyed;

a separating roller configured to rotate about a first rotation axis parallel to a width direction of the conveyor surface and to convey the sheet downstream in a conveyance direction orthogonal to the width direction;

a separating piece located so as to be opposed to the separating roller and configured to cooperate with the separating roller to separate sheets being conveyed one by one;

an attachment member removably attached to the base body at a position at which the attachment member is opposed to the separating roller, so as to form a part of the conveyor surface;

a holder holding the separating piece and supported by the attachment member so as to be movable toward and away from the separating roller; and a first urging member provided between the attachment member and the holder for urging the separating piece toward the separating roller, wherein the conveyor surface is bent at a bent portion so as to define a first surface inclined downward toward the bent portion and a second surface inclined upward from the bent portion and extending toward a downstream side in the conveyance direction, and the attachment member is attached to the base body through an opening formed across the first surface and the second surface.

10. A sheet conveying apparatus, comprising:

a base body having a conveyor surface on which a sheet is conveyed;

a separating roller configured to rotate about a first rotation axis parallel to a width direction of the conveyor surface and to convey the sheet downstream in a conveyance direction orthogonal to the width direction;

a separating piece located so as to be opposed to the separating roller and configured to cooperate with the separating roller to separate sheets being conveyed one by one;

an attachment member removably attached to the base body at a position at which the attachment member is opposed to the separating roller, so as to form a part of the conveyor surface;

a holder holding the separating piece and supported by the attachment member so as to be movable toward and away from the separating roller; and a first urging member provided between the attachment member and the holder for urging the separating piece toward the separating roller, wherein the base body includes a first body portion forming the conveyor surface and a second body portion opposed to the separating roller with the first body portion interposed therebetween, wherein the attachment member is removably attached to the second body portion, wherein the separating roller is supported by the second body portion, and wherein the attachment member includes an engaging portion engaged with the second body portion and a fastened portion fastened to the second body portion.

* * * * *